US011268233B2

(12) United States Patent
Deininger

(10) Patent No.: US 11,268,233 B2
(45) Date of Patent: Mar. 8, 2022

(54) SYSTEM FOR MONITORING A DRYING PROCESS AND METHOD FOR THE OPERATION THEREOF

(71) Applicant: BSH HAUSGERAETE GMBH, Munich (DE)

(72) Inventor: Martina Deininger, Stuttgart-Feuerbach (DE)

(73) Assignee: BSH Hausgeraete GmbH, Munich (DE)

( * ) Notice: Subject to any disclaimer, the term of this patent is extended or adjusted under 35 U.S.C. 154(b) by 126 days.

(21) Appl. No.: 16/609,797

(22) PCT Filed: Apr. 25, 2018

(86) PCT No.: PCT/EP2018/060582
§ 371 (c)(1),
(2) Date: Oct. 31, 2019

(87) PCT Pub. No.: WO2018/202499
PCT Pub. Date: Nov. 8, 2018

(65) Prior Publication Data

US 2020/0056322 A1 Feb. 20, 2020

(30) Foreign Application Priority Data

May 2, 2017 (DE) ..... 102017207324.1

(51) Int. Cl.
*D06F 57/00* (2006.01)
*D06F 58/00* (2020.01)
(Continued)

(52) U.S. Cl.
CPC ..... *D06F 57/00* (2013.01); *D06F 58/00* (2013.01); *D06F 34/05* (2020.02); *D06F 34/18* (2020.02);
(Continued)

(58) Field of Classification Search
CPC ..... D06F 58/30; D06F 58/38; D06F 57/00; D06F 2103/00; D06F 2103/08; D06F 2103/38; D06F 2101/00; D06F 34/28
(Continued)

(56) References Cited

U.S. PATENT DOCUMENTS 4,797,656 A * 1/1989 Keppler ..... G08B 1/08 340/539.26
5,566,471 A * 10/1996 Hirano ..... D06F 57/00 34/201
(Continued)

FOREIGN PATENT DOCUMENTS

CN 104372558 A 2/2015
CN 204551075 U 8/2015
(Continued)

OTHER PUBLICATIONS

Bauer, Vera: "Peggy: Die smarte Wäscheklammer informiert über Wäsche und Wetter", [Peggy:The smart clothes peg provides information about laundry and weather], Gadget article Apr. 23, 2016—English abstract.
(Continued)

*Primary Examiner* — Stephen M Gravini
(74) *Attorney, Agent, or Firm* — Laurence A. Greenberg; Werner H. Stemer; Ralph E. Locher

(57) ABSTRACT

A system for monitoring a drying process for damp laundry items outside a laundry treatment appliance includes, as components to be located in a plurality of appliances that are spatially separate from one another, at least one sensor device including at least one air humidity sensor and a first radio unit for a wireless information exchange with an external evaluation unit and/or an external display device which, to this end, have at least one second radio unit and a first sensor device to be placed in the vicinity of the damp laundry items. An evaluation unit is provided for sensor
(Continued)

signals from the sensor device. A display device displays information for a user of the system. A method for operating the system is also provided.

18 Claims, 1 Drawing Sheet

(51) Int. Cl.

| | |
|---|---|
| ***D06F 103/00*** | (2020.01) |
| ***D06F 103/08*** | (2020.01) |
| ***D06F 58/38*** | (2020.01) |
| ***D06F 103/38*** | (2020.01) |
| ***D06F 58/50*** | (2020.01) |
| ***D06F 105/58*** | (2020.01) |
| ***D06F 34/05*** | (2020.01) |
| ***D06F 34/18*** | (2020.01) |
| ***D06F 101/20*** | (2020.01) |

(52) U.S. Cl.
CPC ..... *D06F 58/38* (2020.02); *D06F 58/50* (2020.02); *D06F 2101/20* (2020.02); *D06F 2103/00* (2020.02); *D06F 2103/08* (2020.02); *D06F 2103/38* (2020.02); *D06F 2105/58* (2020.02)

(58) Field of Classification Search
USPC ..... 34/90, 589–600
See application file for complete search history.

(56) References Cited

U.S. PATENT DOCUMENTS

| | | | | |
|---|---|---|---|---|
| 8,760,307 | B2 * | 6/2014 | Falcioni | A47L 15/46 340/657 |
| 9,518,354 | B2 * | 12/2016 | Kulkarni | D06F 34/18 |
| 9,628,877 | B2 * | 4/2017 | Metz | H04W 4/029 |
| 9,951,465 | B1 * | 4/2018 | Herschler | D06F 34/04 |
| 10,012,971 | B2 * | 7/2018 | Pietsch | A47L 15/0063 |
| 10,443,182 | B2 * | 10/2019 | Adkins | D06F 34/30 |
| 10,697,104 | B2 * | 6/2020 | Ficke | D06F 34/05 |
| 10,705,494 | B2 * | 7/2020 | Ha | H04L 12/2809 |
| 10,731,289 | B2 * | 8/2020 | Kim | D06F 58/30 |
| 10,756,922 | B2 * | 8/2020 | Doerner | H04W 4/38 |
| 10,793,996 | B2 * | 10/2020 | Seo | D06F 58/36 |
| 10,808,351 | B1 * | 10/2020 | Flachsbart | D06F 34/26 |
| 10,900,164 | B2 * | 1/2021 | Seok | D06F 58/30 |
| 10,989,592 | B2 * | 4/2021 | Neumaier | G01J 3/0272 |
| 2009/0145862 | A1 | 6/2009 | Yang | |
| 2020/0056322 | A1 * | 2/2020 | Deininger | D06F 58/16 |

FOREIGN PATENT DOCUMENTS

| | | | | |
|---|---|---|---|---|
| CN | 205134031 | U | 4/2016 | |
| CN | 105534239 | A | 5/2016 | |
| CN | 105915732 | A | 8/2016 | |
| CN | 106325848 | A | 1/2017 | |
| CN | 106350972 | A | 1/2017 | |
| CN | 205975114 | U | 2/2017 | |
| DE | 102016104580 | B3 | 3/2017 | |
| DE | 102017207324 | A1 * | 11/2018 | D06F 58/16 |
| EP | 1744248 | A1 * | 7/2005 | G05B 23/0227 |
| WO | WO-2018202499 | A1 * | 11/2018 | D06F 58/16 |

OTHER PUBLICATIONS

Wang Xiaojin: "Solve Question of Mind and Seek Truth of Invention", Wuhan University Press, Nov. 30, 2012, pp. 168-169—English abstract.

* cited by examiner

FIG. 1
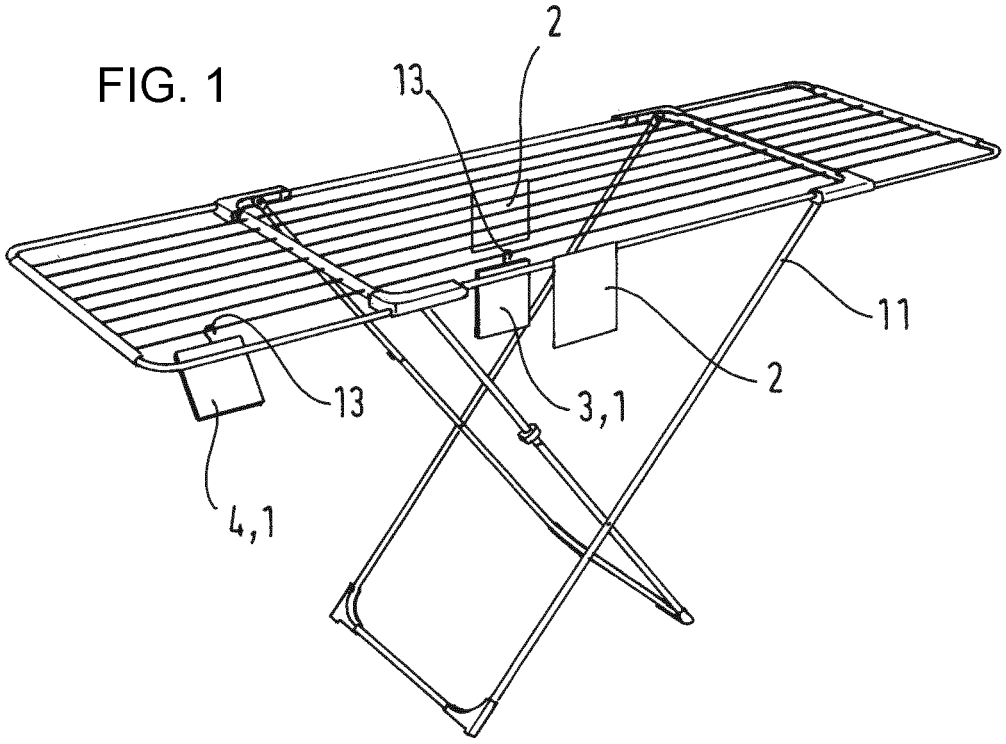
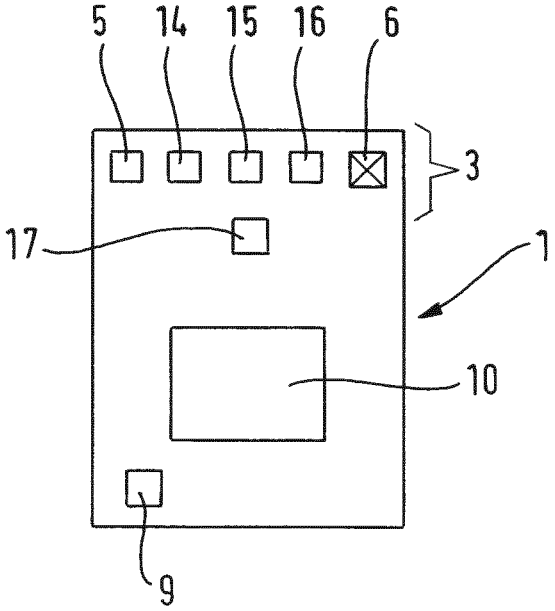
FIG. 2
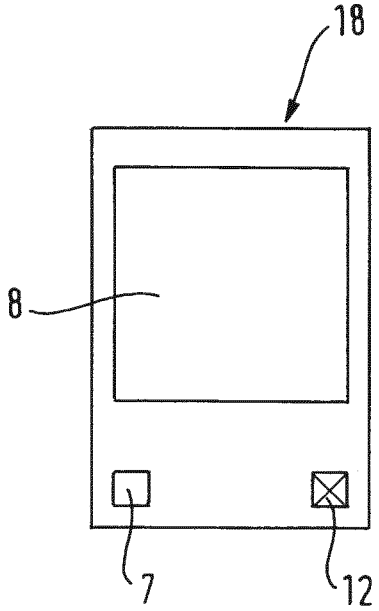
FIG. 3

SYSTEM FOR MONITORING A DRYING PROCESS AND METHOD FOR THE OPERATION THEREOF

BACKGROUND OF THE INVENTION

Field of the Invention

The invention relates to a system for monitoring a drying process for damp laundry items outside a laundry treatment appliance and to a method for operating the system.

There are many options for drying laundry items. Thus there are laundry driers in which the moisture from the laundry items may be measured in the drum containing the damp laundry items. The laundry may be dried according to a drying program set by the user of the laundry drier, wherein it is possible to detect when the laundry items are dry according to this presetting. However, damp laundry items may also be air-dried inside or outside a building, i.e. indoors or outdoors, on laundry airers, laundry lines or the like (also denoted as a whole herein as "laundry hanging device"). Moreover, whilst many textiles are now suitable for use in a drier, there are also some types of fibers, in particular natural fibers, which due to their sensitive structure may only be air-dried, in particular in enclosed spaces.

However, due to insufficient information about the drying status of the laundry or due to laziness, the air drying method has not been pursued and has been neglected by many households.

If, for example, the drying location is not located in the living area or field of view of the user, the laundry items which are located on a laundry hanging device in order to be dried may rapidly be forgotten on a daily basis. It might then be possible to forget to take down the laundry items. Specifically when drying in the open air it might be expedient with regard to weather influences and other environmental influences if a user were to be informed in good time about when a desired degree of drying had been reached.

Moreover, generally the possibility of monitoring the drying process, in particular knowing the progress of the drying process and the end of the drying process, might be expedient.

SUMMARY OF THE INVENTION

In view of this background, it was the object of the present invention to provide a system and a method for the operation thereof which permit optimized air drying.

In particular, monitoring the air drying is intended to be simplified for a user, wherein preferably the potential risks of air drying such as rain, storms and darkness when drying in the open air or too high a level of air humidity when drying indoors, which may encourage the formation of mold, should also be able to be avoided.

This object is achieved according to this invention by a system for monitoring a drying process for damp laundry items outside a laundry treatment appliance as well as a method for the operation thereof having the features of the corresponding independent claims. Preferred embodiments of the system according to the invention and the method according to the invention are set forth in the respective dependent claims. Preferred embodiments of the method according to the invention correspond to preferred embodiments of the system according to the invention and vice-versa even if this is not explicitly stated herein.

Thus the subject of the invention is a system for monitoring a drying process for damp laundry items outside a laundry treatment appliance, containing as components, which can be located in a plurality of appliances that are spatially separate from one another:

(a) at least one sensor device comprising at least one air humidity sensor and a first radio unit for a wireless information exchange with an external evaluation unit and/or an external display device which, to this end, have at least one second radio unit, wherein a first sensor device is arrangeable in the vicinity of the damp laundry items;

(b) an evaluation unit for sensor signals from the sensor device; and (c) a display device for displaying information for a user of the system.

The term "radio unit" used herein is to be understood broadly. In particular, the term also encompasses a bidirectional exchange of information. Within the meaning of the invention, in particular, a radio unit permits a wireless connection by means of WLAN, Bluetooth and/or a radio standard which has been specifically developed for the domestic appliance field. In particular, therefore, a link to the Internet is also possible in order to be able to recall information therefrom, for example, or to be able to carry out evaluations.

The first sensor device should be located in the vicinity of the laundry items to be dried. Preferably, in this case the first sensor device should be positioned such that the signals determined thereby, i.e. sensor signals, permit a determination of the surrounding conditions which is as reliable as possible. In this case, the requirements for positioning the first sensor device are dependent, on the one hand, on the type and accuracy of the desired information about the surrounding conditions, the drying sequence and the probable drying period. On the other hand, the type of "positioning space" will also have an effect on whether it is an enclosed space, for example, or the laundry items are hung out in the open air.

If herein a first sensor device is arranged in the vicinity of the damp laundry items, this preferably means that the spacing between the first sensor device and the damp laundry items, when drying in the open air, is at most two meters, preferably at most one meter and even more preferably at most 50 cm. When drying indoors, where generally only a very small airflow is present, this spacing may be greater.

In one embodiment of the invention, the first sensor device is enclosed by an at least partially open casing, for example a cage, in order to ensure a minimum spacing between the first sensor device and the damp laundry items.

Preferably, the evaluation unit is designed to take into account the positioning conditions when evaluating the signals from the first sensor device, for example the size of a positioning space and the placing of the laundry items and the first sensor device. This may be achieved by suitably designed software of the evaluation unit.

Immediately after the start of a drying process, the evaporation of the moisture contained in the damp laundry items will have barely influenced the surrounding conditions which were originally present. Therefore, important information about the surrounding conditions may be obtained immediately after the start simply by using the first sensor device. In order to increase the accuracy, a measurement of the surrounding conditions may be carried out by the first sensor device, even before hanging out the damp laundry items and placing said laundry items in the vicinity of the first sensor device. In this case, when an acceleration sensor is present the first sensor device may be automatically started or this may be carried out directly by a user who to this end may actuate a switch on the first sensor device or may switch on the sensor device wirelessly by using, for example, the first radio unit.

From the determined values regarding the local air temperature, air humidity and the average wind strength, the time period which is required for removing a specific quantity of water may be calculated in any case by means of the evaluation unit by using suitable algorithms. This calculated time period may be communicated to the user in order to assist the user with daily planning of further activities.

In a preferred embodiment of the invention, the system contains a second sensor device which is arranged at a distance from the damp laundry items. In this case, the second sensor device preferably contains the same number and type of sensors as the first sensor device. In this case, "arranged at a distance" preferably means here that the spacing between the second sensor device and the damp laundry items when drying in the open air is more than 50 cm, preferably more than a meter and even more preferably more than two meters.

Thus, for example, the measured variables determined on a laundry airer by means of the sensor signals from the first sensor device may be compared with those of the second sensor device which is located at a short distance from the airer, and the comparison may be used in order to provide the user with a more accurate prediction about the completion of the drying process and an optimal airing of the laundry items. For example, when drying inside a building, an instruction, in particular a recommendation, could be provided via, for example, a smartphone. For example, a user could be recommended to open a window. This may also be carried out if the system is linked to a smart home network, for example.

Preferably, therefore, the system is designed to take into account the sensor signals from the second sensor device as reference values in order to evaluate the sensor signals from the first sensor device in the evaluation unit. This is particularly advantageous when the external conditions, for example the air humidity and temperature, change due to circumstances which are not attributed to the damp laundry items per se. This is primarily the case when the damp laundry items are hung out in the open air where, due to changes in the weather conditions, the temperature and humidity, but in particular also the airflows, may change.

Generally, the damp laundry items are placed for drying such that they are not able to come into contact with dirty surfaces, for example a floor surface, and moreover their surroundings may provide a maximum surface for optimal evaporation of the moisture. In a preferred embodiment of the invention, therefore, the first sensor device is arranged on a laundry hanging device, for example a mobile laundry airer, or on an immobile laundry hanging device comprising laundry lines, generally arranged in the open air, which are also used for drying the damp laundry items. In this case, the first sensor device is generally suspended between the damp laundry items to be dried.

To this end, the first sensor device is preferably provided with a mounting which in a preferred embodiment is designed to be theft-proof and which permits the attachment of the first sensor device to the laundry hanging device, for example by being clipped on. To this end, in particular, a clothes hanger may also be used. Optionally, when ensuring a sufficiently large spacing from the damp laundry items the second sensor device may also be provided with such a mounting and attached in a similar manner to the laundry hanging device, but at a greater distance from the damp laundry items.

The evaluation unit evaluates the sensor signals from the sensor device. This means, in particular, that the sensor signals from the first sensor device are evaluated, wherein preferably the sensor signals from an optionally present second sensor device may also be taken into account. Since the sensor signals may be influenced by a plurality of factors, the evaluation software of the evaluation unit and, in particular, correlations between these factors and the sensor signals which are also stored in the evaluation unit have a particular importance. Among these factors, in addition to the positioning conditions which have been already discussed, are further factors which preferably may be taken into account in order to increase the accuracy of the evaluation unit, in particular the number, size, shape and material of the damp laundry items. Preferably the software also takes into account the size of a space in which the damp laundry items are hung out. These factors will generally have an effect on the speed of the evaporation of the moisture contained in the damp laundry items.

According to the invention it is preferred if the evaluation unit is designed to determine a drying period of the damp laundry items using the sensor signals. Generally, the specific drying period is then displayed on the display device.

Finally, the evaluation unit is preferably designed to determine when the end of a drying process of the damp laundry items has been reached by using the sensor signals, and to display this on the display device.

The accuracy of the aforementioned conditions is dependent on the accuracy of the sensor signals. It may be the case here that a plurality of sensors may be added to one another such that they are able to deliver different information about significant factors influencing the drying process.

In the system according to the invention, therefore, it is particularly preferred that the at least one sensor device additionally contains a temperature sensor, an air pressure sensor, an acceleration sensor and/or a light sensor. It is quite particularly preferred if the sensor device contains a temperature sensor, an air pressure sensor, an acceleration sensor and/or a light sensor.

Preferably, the first sensor arrangement is designed to measure the air humidity, acceleration and the temperature. The XDK sensor made by the firm Robert Bosch GmbH which also contains a temperature sensor, a pressure sensor (air pressure sensor), an acceleration sensor and a digital light sensor is particularly suitable therefor. The XDK sensor is able to detect the properties of the surroundings and via WLAN and/or Bluetooth communicate with an external appliance such as, in particular, a tablet computer, a personal computer (PC) or a smartphone. Moreover, it may also serve as an evaluation system for signals from the sensors located therein and due to the LEDs attached thereto also serve as a display unit. A development of the XDK sensor is conceivable, for example by enlarging a display or removing unnecessary sensor systems in order to reduce the overall weight. Thus the XDK sensor may also be regarded as a system within the meaning of the invention in which the components (a), (b) and (c) are present in one appliance. In this system it is also possible in principle for a user to track a drying process by means of the display device of the system integrated in the appliance.

Finally, according to the invention a system is preferred in which the sensor device contains an acceleration sensor. This is advantageous for many reasons.

In this case, the air circulation may be taken into account, namely for monitoring a drying process, since advantageously due to the movement of the acceleration sensor conclusions may be drawn about the air circulation. Moreover, the moisture removed by the air may be estimated therefrom. In this case, suitable software is generally stored in the evaluation unit, wherein in particular empirical values regarding the correlation between the air circulation and the removal of moisture may also be taken into account.

Moreover, acceleration signals from the acceleration sensor regarding the presence of winds which are too high or other problems may be evaluated and a warning signal displayed to a user on the display device. In this case, the evaluation apparatus may also transmit a suitable alarm signal which may be displayed on the display device. In the presence of high winds, this alarm signal on the display device may be linked to the request to bring in the laundry. In the case of other problems, for example laundry items covering the sensor due to the wind, this alarm signal on the display device may be linked to the request to monitor the state of the damp laundry items. Such a function may also be set, for example, to remind a user when the end of the drying process has already been reached.

The aforementioned system comprising a sensor device having at least two sensors, in particular the evaluation unit thereof, is preferably designed to permit a user to choose one of the following application modes:

(i) outdoor mode in which the external conditions at a location where the damp laundry items are hung out are taken into account, by the sensor device, in particular the first sensor device, measuring the temperature, the pressure, the acceleration and/or the light intensity as external conditions at the location where the laundry items are hung out, which sensor signals are then taken into account in the evaluation unit;

(ii) indoor mode in which the spatial conditions at the location where the damp laundry items are hung out are taken into account, by the sensor device measuring the temperature, the acceleration and/or the light intensity as spatial conditions at the location where the laundry items are hung out, which sensor signals are then taken into account in the evaluation unit;

(iii) basic mode in which only the drying period and/or the end of the drying process of the damp laundry items are determined, for example based on a database or a predetermined time.

In these modes in the system a user may preferably predetermine different degrees of drying or types of laundry (thin, thick, mixed, material) which correspond to an end of the drying process to be determined and to be displayed.

In a preferred embodiment of the invention which, in particular, is suitable for use outdoors, at least at the start of the method the solar radiation is also measured via a temperature sensor and/or a light sensor, for example also over the course of the day.

In outdoor mode, the first sensor device and evaluation unit are preferably designed to detect when it becomes dark outside and/or when it starts to rain, so that the laundry items should be brought back into the house. After such a detection generally a corresponding request is then sent to the user via the display device.

In indoor mode, the first sensor device, in particular, may be designed in order to monitor the surrounding conditions in the drying area in addition to monitoring the progress of a drying process. Finally, the drying of the damp laundry items should not result in encouraging the formation of mold. Thus the sensor system may be designed to provide an alarm signal when a predetermined maximum air humidity is reached in the drying area.

Generally the evaluations cited under (i), (ii) and (iii) are also shown on the display device.

In a preferred embodiment of the aforementioned system, in outdoor mode (i) the evaluation unit is designed to request weather information from the Internet and to take this weather information into account when evaluating the sensor signals. The weather information comprises, in particular, current and future local data regarding temperature, air humidity and wind strength, since these parameters substantially influence the drying speed of the damp laundry items in the open air. The higher the outside air temperature and the lower the air humidity, the higher the drying speed since the material flow density is proportional to the concentration gradient of the material. Moreover, the wind strength significantly influences the speed of removing the water molecules via forced convection.

In a particularly preferred embodiment of the system according to the invention, the sensor device has an air pressure sensor for detecting a weather forecast and/or a water droplet sensor for detecting raindrops.

If the chemical characteristic of the surroundings of the damp laundry items may also be determined by means of the first sensor arrangement (determining, for example, a concentration of ozone and/or oxygen in the surroundings) it may also be established how hygienically the drying process is being carried out.

It is further preferred if the evaluation unit calculates from the data received by the first sensor device, optionally in combination with weather data from the Internet and/or from a second sensor device, a predicted drying time for air drying the damp laundry items.

In the system according to the invention, the evaluation apparatus is preferably designed to transmit an alarm signal to the display device when a predetermined upper limit value $H_{lim}$ for the air humidity is exceeded when it starts to rain and/or with the onset of darkness. These situations are also frequently associated with an increase in the air humidity. Generally this alarm signal is then displayed on the display device. In this case, in particular, the requirement to bring in the laundry may be indicated.

In order to permit tracking of a drying program, preferably for different degrees of moisture in the laundry items, the chronological development of the air humidity at the location of the first sensor device is stored in a memory unit, for example in the evaluation unit, so that this correlation may be used for the evaluation. In this case, it is also expedient to take into account the quantity and preferably also the arrangement of the laundry items relative to the first sensor device.

In any case the air humidity increases over time and reduces during the drying process, toward the end thereof. Depending on the air humidity in the surroundings of the first sensor device over time it may be detected when there is no longer any local increase in the air humidity and the drying process is terminated. Advantageously, to this end a gradient for the chronological increase in air humidity may be predetermined and stored in the evaluation unit. Additionally, further parameters may be used for detecting the drying status of the laundry and a prediction when the laundry will be approximately dry.

Finally, the system according to the invention also permits a user to set different degrees of drying which are intended to be assigned to an end of a drying process to be established by the evaluation unit. Thus a user may establish when the degree of drying, which is desired by the user, is reached.

According to the invention, it is also preferred if the display device is designed to display evaluation signals of the evaluation unit in the form of sounds, light signals, text, symbols and/or vibrations. According to the invention the display device and the type of display, therefore, may be broadly interpreted. Thus the display device, in particular, may be an optical, acoustic and/or vibrating display device.

In the system according to the invention, the sensor system and evaluation unit but also the sensor system, evaluation unit and display system may be integrated in a housing. Preferably in both cases, however, a display system is alternatively and/or additionally arranged in an external appliance which is connected via a wireless connection to the sensor system and the evaluation unit. This may be implemented, in particular, by using a mobile terminal such as for example a smartphone, a tablet computer or a specific appliance for controlling a plurality of domestic appliances in a networked household, so-called smart home technology.

Similarly, the evaluation unit together with the sensor system may be placed in an appliance or separated therefrom. For example, the evaluation unit could also be located on one of the aforementioned mobile terminals, i.e. a smartphone, a tablet computer or a specific appliance for controlling a plurality of domestic appliances in a networked household. Finally, the option of linking to the Internet also provides the possibility of carrying out the evaluation of the sensor signals in a so-called cloud, which then in turn may be connected wirelessly to the display device. The information about the average time required for drying the laundry and further evaluation variables may be stored in the cloud, for example for optimizing the predictive capacity of the algorithm used.

In a particularly preferred embodiment, the system according to the invention is integrated in a system of domestic appliances which are networked together. In this manner, the system according to the invention is able to exchange data with further domestic appliances, for example a washing machine, in order to obtain from these appliances, for example, information about the type and nature of the laundry items to be dried.

Moreover, the system according to the invention may be connected to an external computer system which is specific to the household. An external computer system frequently has a relatively large computing capacity. Thus more complex and computation-intensive algorithms may be implemented and the results thereof supplied to the system which in this manner reduces the load on said system. Additionally, greater quantities of data may be received from the Internet and suitably processed by an external computer system. It is conceivable to call up different weather forecast systems in order to permit a comparison of the available data and to improve the resilience of the information obtained.

For the energy supply of the system and its components conventional batteries or rechargeable batteries, in particular rechargeable lithium-ion batteries are suitable. However, in principle an autonomous energy supply may also be used.

A further subject of the invention is a method for operating a system for monitoring a drying process for damp laundry items outside a laundry treatment appliance, containing as components which can be located in a plurality of appliances that are spatially separate from one another:

(a) at least one sensor device comprising at least one air humidity sensor and a first radio unit for a wireless information exchange with an external evaluation unit and/or an external display device which, to this end, have at least one second radio unit, wherein a first sensor device is arrangeable in the vicinity of the damp laundry items;

(b) an evaluation unit for sensor signals from the sensor device; and (c) a display device for displaying information for a user of the system, wherein the method comprises the steps (i) hanging out the damp laundry items at a location where the damp laundry items are hung out;

(ii) switching on the sensor device;

(iii) measurement of the sensor signals by the sensor device; and (iv) evaluation of the sensor signals by the evaluation unit at least regarding a probable drying period and/or an end of a drying process.

The invention has numerous advantages. Thus a drying period may be predicted at least approximately as a function of the surrounding conditions. Moreover, a desired end of the drying process may be displayed to a user. In this case, even unforeseen and/or undesired events may be taken into account. In any case, a user may be told in good time to take measures such as bringing in the laundry items. In the embodiments of the invention, the user may obtain accurate information about the sequence of the drying process.

BRIEF DESCRIPTION OF THE SEVERAL VIEWS OF THE DRAWING

Further details of the invention are disclosed in the following description of non-limiting embodiments. In this case reference is made to FIGS. 1 to 3.

In FIG. 1 a laundry airer is shown as an exemplary laundry hanging device in which the drying process of suspended damp laundry items may be tracked by a system according to the invention.

In FIG. 2 an exemplary system according to the invention which is used on the laundry airer of FIG. 1 is shown schematically.

In FIG. 3 a smartphone which contains the components including the evaluation unit and display device of the system according to the invention is shown.

DESCRIPTION OF THE INVENTION

FIG. 1 shows a laundry airer 11 as an exemplary laundry hanging device on which damp laundry items 2 are suspended in order to be air-dried. A system 1 according to the invention is arranged between the damp laundry items 2, the three components including the sensor device 4, evaluation unit and display device, which however are not visible here in more detail, being arranged in one appliance in this case. A first radio unit is contained in this appliance, therefore, the link to a wireless network via for example WLAN or Bluetooth being possible thereby. However, the display device in this case is substantially limited to several LEDs for the display of status information, for example regarding the charging state of a rechargeable lithium-ion battery, also not shown here, and/or a drying state of the laundry items which has been reached.

The sensor device, in this case a first sensor device 3, is provided with a mounting 13, the system 1 being fastened thereby to the laundry airer.

In the embodiment of the invention shown in FIG. 1, a second sensor device 4 which is also provided with a mounting 13 is additionally used. Via the mounting 13 the second sensor device 4 is also attached to the laundry airer 13 but at a greater distance from the damp laundry items 2.

In this manner, the second sensor device 4 is capable of determining reference data regarding the surrounding conditions. The sensor device 4 and a further evaluation unit for evaluating the sensor signals from the sensor device 4 and a second radio unit are also integrated in an appliance, not shown in more detail here.

Both sensor devices 3 and 4 are designed in order to communicate wirelessly with an external display device, for example a smartphone.

FIG. 2 shows the system according to the invention used in FIG. 1 by way of example in a non-limiting embodiment, comprising a first sensor device 3 in addition to a humidity sensor 5, a temperature sensor 14, an air pressure sensor 15, an acceleration sensor 16 and a light sensor 17 and a first radio unit 6. The system 1 shown here by way of example contains in addition to the first sensor device 3 an evaluation unit 9 which is integrated in the same appliance and an integrated display device 10, wherein said display device, not shown in more detail, in this case substantially contains LEDs for displaying status information. An installed loudspeaker additionally permits the emission of acoustic signals, for example warning signals, with the onset of rain or the onset of darkness.

A smartphone 18 which contains the components including the evaluation unit and display device of the system according to the invention is shown in FIG. 3. These components are thus an external evaluation unit 7 and an external display device 8. In particular, the external display device 8 permits a user to monitor a drying process taking place at a distance, for example on the laundry airer of FIG. 1. To this end, the display device 8 is provided with acoustic, optical and vibrating display means. In the embodiment shown here an external evaluation unit 7 is contained in the smartphone 18, the evaluations thereof being able to be communicated to a user via the display device 8. Thus the second radio unit 12 shown here represents, in particular, a radio connection with a sensor device, not shown here, for example to a laundry airer or a network, for example the Internet. In embodiments of the invention, however, when using a smartphone it is possible to dispense with the smartphone having an external evaluation unit.

REFERENCE NUMERALS

1 System for monitoring a drying process
2 Damp laundry items
3 Sensor device, first sensor device
4 Sensor device, second sensor device
5 Humidity sensor
6 First radio unit
7 External evaluation unit, for example smartphone, tablet computer
8 External display device
9 Integrated evaluation unit
10 Integrated display device
11 Laundry hanging device, laundry airer
12 Second radio unit
13 Mounting
14 Temperature sensor
15 Air pressure sensor
16 Acceleration sensor
17 Light sensor
18 Smartphone

The invention claimed is:

1. A system for monitoring a drying process for damp laundry items outside a laundry treatment appliance, the system comprising:

components being spatially separate from one another as follows:

(a) at least one sensor device including at least one air humidity sensor and a first radio unit for a wireless information exchange with at least one of an external evaluation unit or an external display device having at least one second radio unit, said at least one sensor device including a first sensor device to be placed in a vicinity of the damp laundry items being dried outside a laundry treatment appliance;

(b) an evaluation unit for evaluating sensor signals from said at least one sensor device, said evaluation unit configured to transmit an alarm signal to said display device upon a predetermined upper limit value for an air humidity being exceeded due to at least one of rain or darkness; and (c) a display device for displaying information for a user of the system.

2. The system according to claim 1, which further comprises a second sensor device disposed at a distance from the damp laundry items.

3. The system according to claim 2, wherein said second sensor device emits sensor signals as reference values for an evaluation of the sensor signals from said first sensor device in said evaluation unit.

4. The system according to claim 1, which further comprises a laundry hanging device used for drying the damp laundry items, said first sensor device being disposed on said laundry hanging device.

5. The system according to claim 4, which further comprises a mounting for attaching said first sensor device to said laundry hanging device.

6. The system according to claim 1, wherein said evaluation unit is configured to determine a drying period of the damp laundry items using the sensor signals.

7. The system according to claim 1, wherein said evaluation unit is configured to determine when an end of a drying process of the damp laundry items has been reached by using the sensor signals and is configured to display the end of the drying process on said display device.

8. The system according to claim 1, wherein said at least one sensor device additionally contains at least one of a temperature sensor, an air pressure sensor, an acceleration sensor or a light sensor.

9. The system according to claim 8, wherein the system is configured to permit a user to choose one of:

(i) an outdoor mode in which external conditions at a location where the damp laundry items are hung out are taken into account by using said at least one sensor device to measure at least one of a temperature, a pressure, an acceleration or a light intensity as external conditions at the location where the damp laundry items are hung out, said evaluation unit then taking the sensor signals into account; or (ii) an indoor mode in which spatial conditions at the location where the damp laundry items are hung out are taken into account by using said at least one sensor device to measure at least one of a temperature, an acceleration or a light intensity as spatial conditions at the location where the damp laundry items are hung out, said evaluation unit then taking the sensor signals into account; or (iii) a basic mode in which only at least one of a drying period or an end of the drying process of the damp laundry items are determined.

10. The system according to claim 9, wherein in said outdoor mode (i) said evaluation unit is configured to request weather information from the Internet and to take the weather information into account when evaluating the sensor signals.

11. The system according to claim 9, wherein said at least one sensor device has at least one of an air pressure sensor for detecting a weather forecast or a water droplet sensor for detecting raindrops.

12. The system according to claim 1, wherein said display device is configured to display evaluation signals of said evaluation unit as at least one of sounds, light signals, text, symbols or vibrations.

13. The system according to claim 1, wherein said at least one sensor device contains an acceleration sensor and is configured to evaluate acceleration signals from said acceleration sensor regarding a presence of winds which are too high or other problems and to display a warning signal relative thereto to a user on said display device.

14. A method for operating a system for monitoring a drying process for damp laundry items outside a laundry treatment appliance, the method comprising the following steps:

providing components being spatially separate from one another as follows:

(a) at least one sensor device including at least one air humidity sensor and a first radio unit for a wireless information exchange with at least one of an external evaluation unit or an external display device having at least one second radio unit, the at least one sensor device including a first sensor device to be placed in a vicinity of the damp laundry items being dried outside a laundry treatment appliance;

(b) an evaluation unit for evaluating sensor signals from the at least one sensor device; and (c) a display device for displaying information for a user of the system;

(i) hanging out the damp laundry items at a location suitable for hanging out damp laundry items for drying the damp laundry items outside the laundry treatment appliance;

(ii) measuring sensor signals by using the at least one sensor device;

(iii) using the evaluation unit to evaluate the sensor signals at least regarding at least one of a probable drying period or an end of the drying process; and (iv) using the evaluation unit to transmit an alarm signal to the display device upon a predetermined upper limit value for an air humidity being exceeded due to at least one of rain or darkness.

15. The system according to claim 1, which further comprises a mounting configured to attach said first sensor device to a laundry hanging device.

16. The system according to claim 15, wherein said mounting is configured to clip said first sensor device to the laundry hanging device.

17. The method according to claim 14, which further comprises mounting the first sensor device to a laundry hanging device.

18. The method according to claim 17, which further comprises carrying out the mounting step by clipping the first sensor device to the laundry hanging device.

* * * * *